US011559977B2

(12) United States Patent
Visini et al.

(10) Patent No.: US 11,559,977 B2
(45) Date of Patent: Jan. 24, 2023

(54) PLATE SLEEVE-HOLDER CYLINDER MADE OF CARBON-FIBRE COMPOSITE MATERIAL FOR FLEXOGRAPHIC PRINTING AND INCLUDING COMPRESSED AIR CHANNELS

(71) Applicant: LAMIFLEX S.p.A., Ponte Nossa BG (IT)

(72) Inventors: Christian Visini, Ponte Nossa BG (IT); Marco Perani, Ponte Nossa BG (IT)

(73) Assignee: LAMIFLEX S.p.A., Ponte Nossa BG (IT)

( * ) Notice: Subject to any disclaimer, the term of this patent is extended or adjusted under 35 U.S.C. 154(b) by 0 days.

(21) Appl. No.: 17/126,755

(22) Filed: Dec. 18, 2020

(65) Prior Publication Data

US 2021/0187936 A1 Jun. 24, 2021

(30) Foreign Application Priority Data

Dec. 19, 2019 (IT) ..... 102019000024820

(51) Int. Cl.

| | |
|---|---|
| ***B41F 5/24*** | (2006.01) |
| ***B41F 27/14*** | (2006.01) |
| ***B41F 13/12*** | (2006.01) |
| ***B41F 27/00*** | (2006.01) |

(52) U.S. Cl.

CPC ..... *B41F 13/12* (2013.01); *B41F 5/24* (2013.01); *B41F 27/005* (2013.01); *B41P 2227/20* (2013.01)

(58) Field of Classification Search

None

See application file for complete search history.

(56) References Cited

FOREIGN PATENT DOCUMENTS

| | | | | |
|---|---|---|---|---|
| DE | 10008218 A1 * | 8/2001 | ..... | B41F 13/08 |
| DE | 202007011929 U1 * | 11/2007 | ..... | B41F 27/105 |
| EP | 1 567 341 A1 | 8/2005 | | |
| IT | 2018 0000 3066 A1 | 8/2019 | | |

OTHER PUBLICATIONS

English translation of IT 10 2018 0000 3066 A1 from EPO website. (Year: 2018).*

* cited by examiner

*Primary Examiner* — Leslie J Evanisko

(74) *Attorney, Agent, or Firm* — Bay State IP, LLC

(57) ABSTRACT

A plate sleeve-holder cylinder provided with a carbon-fibre central tube (T) comprising compressed air channels (6, 7, 8) arranged between one of the end flanges (Fb, Fm) of said plate sleeve-holder cylinder and a plurality of holes (H) formed in the outer surface of said central tube (T) made of carbon-fibre composite material. Said air channels (6, 7, 8) are partly embedded within said end flanges (Fb, Fm), partly within a thickness of a side wall (P) of said central tube (T) made of carbon-fibre composite material. Additionally, a process of manufacturing said central tube (t) is disclosed by inserting air pipes (6) into grooves (1) which are formed by mechanical milling of a surface of the supporting structure (P) of said central tube (T) obtained through a first lamination and polymerization, said grooves being coated with a surface finishing structure (S) obtained through a second lamination and polymerization.

9 Claims, 5 Drawing Sheets

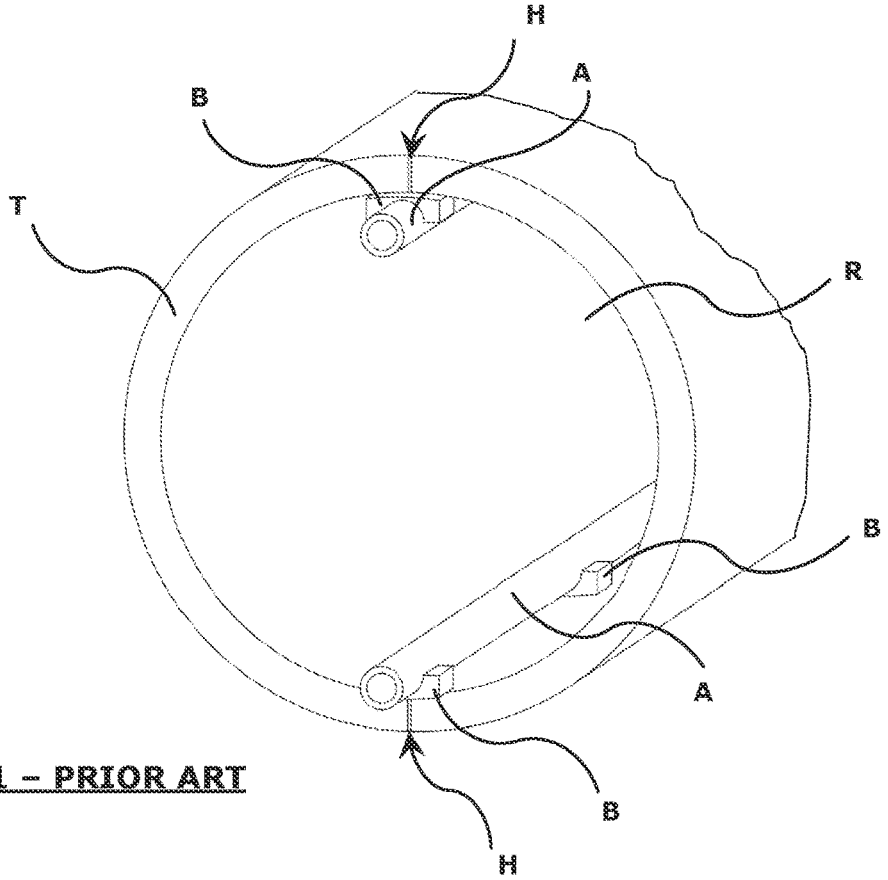
Fig. 1 – PRIOR ART
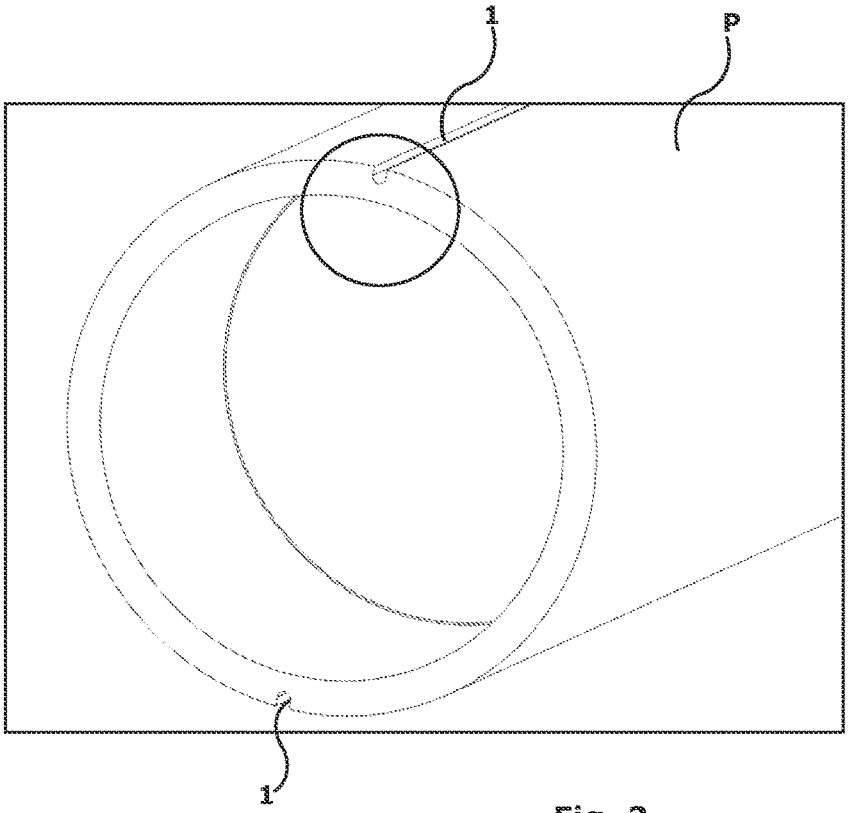
Fig. 2

PLATE SLEEVE-HOLDER CYLINDER MADE OF CARBON-FIBRE COMPOSITE MATERIAL FOR FLEXOGRAPHIC PRINTING AND INCLUDING COMPRESSED AIR CHANNELS

CROSS REFERENCE TO RELATED APPLICATION

This application claims the benefit of and takes priority from Italian Patent Application No. 102019000024820 filed on Dec. 19, 2019, the contents of which are herein incorporated by reference.

BACKGROUND OF THE INVENTION

Field of the Invention

The present invention relates to a plate sleeve-holder cylinder used in a flexographic printing process.

More specifically, the invention relates to a plate sleeve-holder cylinder for flexographic printing, whose central tube is made of carbon-fibre composite material, wherein low-volume pipes are provided for delivering compressed air onto the outer surface of the plate sleeve-holder cylinder, in view to ease sleeve insertion thereon. The invention also relates to a preferred manufacturing process of said central tube made of carbon-fibre composite material.

Description of the Related Art

As well known to the skilled man in the art, a flexographic printing plate sleeve-holder cylinder of the type described above consists in fact of a central tube and two end flanges steadily joined thereto. Pins integral with said end flanges allow the plate sleeve-holder cylinder to be rotatably mounted on the flexographic printing machine. Traditionally all the elements above were made of steel and mutually assembled by means of press fit and/or welding techniques between the end flanges and the central tube.

Over recent decades, however, steel central tubes have been partially replaced by central tubes made of carbon-fibre composite material—mainly with the purpose of reducing the moment of inertia, increasing the flexural rigidity, and obtaining more effective vibration dampening of the plate sleeve-holder cylinder. In this case, the assembly of the two metallic end flanges equipped with rotation pins with the central tube made of carbon-fibre composite material is obtained by bonding through suitable adhesives said end flanges onto the inner wall of said central tube.

It is also known that in order to rapidly and correctly insert the sleeves onto the plate sleeve-holder cylinder, compressed air is supplied into the hollow inside of the central tube until a working pressure of about 6 bar is reached (with a maximum safety pressure of about 10 bar). The compressed air flows out of through holes provided at suitable positions in the side wall of the aforementioned central tube, and so allows to obtain a moderate expansion of the sleeve, due to its elastic deformability, so that the sleeve can fit onto the plate sleeve-holder cylinder under a reduced friction. Once the sleeve insertion is so duly completed, the supply of compressed air into the central tube is interrupted and the sleeve elastically returns to its initial undeformed shape, thus adhering to the side wall of the plate sleeve-holder cylinder, onto which it is finally blocked before starting the printing process.

During sleeve insertion, a high-pressure chamber is then formed inside the plate sleeve-holder cylinder, which high pressure applies both in the radial direction, i.e., onto the side wall of the central tube, and in the axial direction, i.e., onto the inner portions of the end flanges which close the opposite ends of the central tube. This latter axial thrust therefore causes a high shear stress on the adhesive-bonded contact surface between the central tube and the end flanges.

Under standard conditions, the central tube thickness (which is quite high, in order to also satisfy the central tube mechanical requirements in terms of flexural rigidity) and the bonding length of the end flanges are sufficient to guarantee high safety coefficients with respect to the mechanical stresses caused by the compressed air chamber formed within the central tube. However, occasional critical incidents have occurred—particularly when the flexographic plate sleeve-holder cylinders were used under conditions accidentally out of the project specifications—wherein sudden ejections of the metal flanges from the central tube made of composite material or even total breaks of the same central tube occurred, with the risk of serious consequences for the safety of the operators on the printing machine. Possible reasons of these critical incidents can unfortunately not be easily eliminated in advance, since they depend on hidden defects—such as mixing, storage and/or application defects of the adhesives or structural defects (cracks) within the side wall of the central tubes made of composite material—which become evident only at the moment of failure when lead to an immediate breakage.

Large plate sleeve-holder cylinders for flexographic printing have shown to be particularly sensitive to these issues, particularly when printing on "tissue" supports (i.e., paper for hygienic/sanitary use), where machine size and impulsive loads, which sometimes are higher than standard working conditions, amplify the critical issues mentioned above. It should also be noted that, in this same field of application, the high volume of the compressed air chambers made it necessary to subject plate sleeve-holder cylinders to the regulations in force for pressure vessels, and therefore to the related certifications, with considerable increase of complexity of the authorization procedures and manufacturing costs of these devices.

In recent years, machinery manufacturers have therefore begun to study and propose alternative technological solutions, which do not involve using compressed air in the inner chamber of flexographic printing cylinders, nevertheless with still partial and unsatisfactory results, as briefly described below.

In a first known solution a plate sleeve-holder cylinder is provided, in addition to the usual central tube, with a coaxial inner tube which seals onto an inner shoulder of the end flanges, thus dividing the central tube inner volume into two chambers and forming the compressed air chamber only in the outer one, i.e., in the cylindrical gap between said central tube and said inner tube. However, this solution involves some structural complexity, additional cost for the inner tube and only solves one of the possible drawbacks mentioned above, namely that of the expulsion of the end flanges due to failure of the adhesive bonding thereof to the central tube, thanks to the fact that a lower thrust is applied on said flanges here, as a function of the reduced portion of the flange which is exposed to the pressurized chamber. On the other hand, such a solution does not bring any advantage with respect to the issue of structural stability of the central tube made of composite material, which is in fact subjected to the same pressure conditions as in the case of plate sleeve-holder cylinders having a single chamber.

In an alternative solution of the known art, as disclosed for example in WO-2004050367 (2005) or IT-2018000003066 (2019), schematically illustrated in FIG. 1, one or more compressed air circuits are inserted into the inner chamber R of a plate sleeve-holder cylinder, by means of metallic pipes A which run along the inner side wall of the central tube T made of composite material, and which frontally engage with the end flanges at respective inlet valves. Along the pipes A, branch blocks B are arranged at regular intervals, bonded to the inner surface of the central tube T made of composite material, and communicating both with the outside through holes H formed in the side wall of said central tube T and with the respective pipe A. Compressed air introduced into pipes A from said inlet valves flows therefor out of the holes H provided along the central tube T, easing the sleeve insertion.

Indeed, the above said construction effectively solves the safety issue previously discussed, since compressed air is confined in the very small volume of the pipes A, nevertheless it has shown major drawbacks from the point of view both of the assembly and the reliability of the system in the short and long term, also in consideration of the high length of the flexographic printing cylinders (typically 2800 mm to 3700 mm) which makes quite difficult both assembly and maintenance operations for the aforementioned compressed air circuits.

The technical problem addressed by the present invention is therefore that of providing a plate sleeve-holder cylinder for flexographic printing, with insertion of sleeves eased by compressed air jets, equipped with dedicated air circuits arranged along the plate sleeve-holder cylinder for the delivery of compressed air, wherein said air circuits should exclude the use of the inner chamber of the plate sleeve-holder cylinder and preferably be of simple construction and reliable in their operation over time.

Within the context of finding a solution to this problem, a first object of the present invention is to associate said air circuits to the plate sleeve-holder cylinder structure itself, during its manufacturing process, to obtain a particularly sturdy and reliable structure for such air circuits.

A second object of the present invention is then to minimize the use of additional elements for the construction of said air circuits, in order to limit the increase in costs in the production of the plate sleeve-holder cylinder equipped with such air circuits.

SUMMARY OF THE INVENTION

This problem is solved, and these objects achieved by means of a plate sleeve-holder cylinder for flexographic printing and a manufacturing process of such plate sleeve-holder cylinder, both said plate sleeve-holder and said manufacturing process having the features defined in the claims. Other preferred features of said plate sleeve-holder cylinder and related process are defined in the claims.

BRIEF DESCRIPTION OF THE DRAWINGS

Further features and advantages of the plate sleeve-holder cylinder according to the present invention will in any case become more evident from the following detailed description of a preferred embodiment thereof, provided only by way of non-limiting example and illustrated in the attached drawings, wherein:

FIG. 1 is a schematic perspective view of one end of a central tube of a plate sleeve-holder cylinder of the known art, embodying a compressed air circuit formed by pipes fixed to the side wall of said central tube;

FIG. 2 is a perspective view of one end of a central tube of the plate sleeve-holder cylinder of the present invention, in a first manufacturing step;

DETAILED DESCRIPTION OF THE SEVERAL EMBODIMENTS

According to the present invention, in order to solve the problem highlighted above by means of a constructively simple and immediately applicable solution, the inventors conceived to embed low-volume air pipes for compressed air delivery within the thickness of the side wall of the central tube made of carbon-fibre composite material of a plate sleeve-holder cylinder for flexographic printing. This innovative technical solution, in addition to radically and effectively solving the safety problems exhibited by known plate sleeve-holder cylinders having an inner high-pressure chamber, also allows to considerably simplify the air pipe construction, meanwhile offering significantly higher reliability over time, with respect to the previously discussed prior art solution which discloses pipes positioned in the inner chamber of the plate sleeve-holder cylinder and attached to the side wall thereof.

In general, the compressed air pipes according to the present invention are formed in the central tube made of composite material during the same lamination step thereof—carried out with "wrapping" or "filament winding" technologies or with a combination of the same—by embedding appropriate inserts or mandrels, which may be withdrawable after the resin polymerization, within the thickness of the side wall of said central tube, in order to create one or more straight longitudinal pipes having a desired section.

Figure 3:
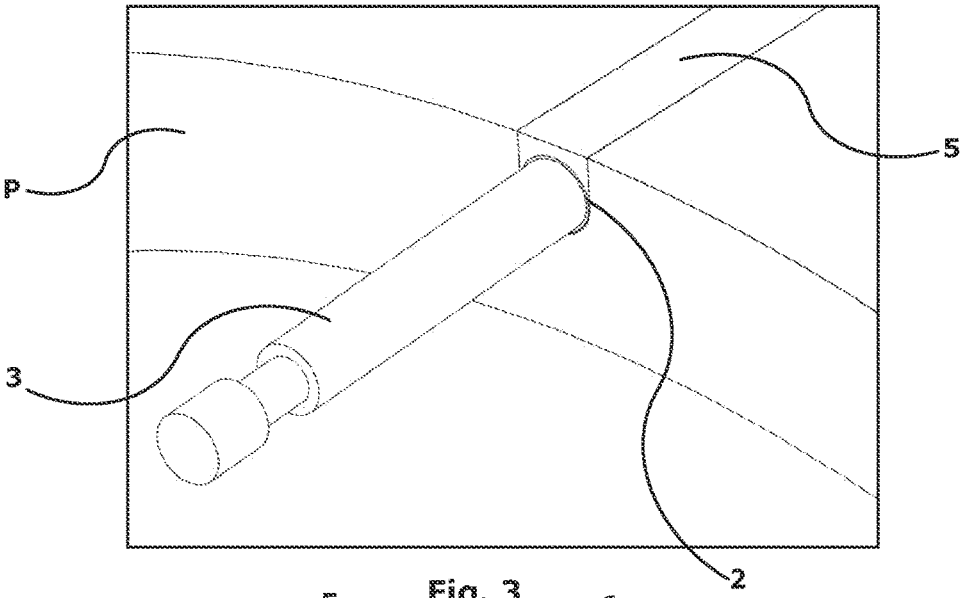
FIGS. 3, 4 and 5 are perspective views of the detail highlighted with a circle in FIG. 2, in successive steps of the central tube manufacturing.
Figure 4:
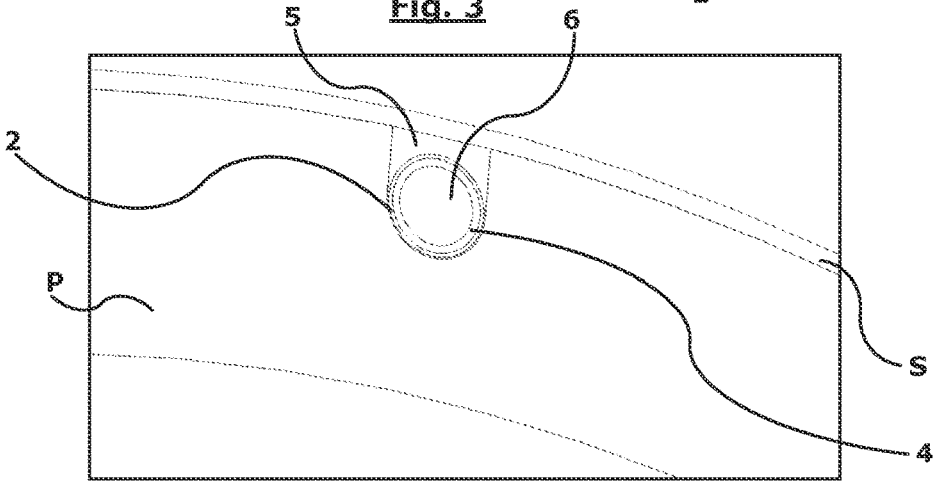
Figure 5:
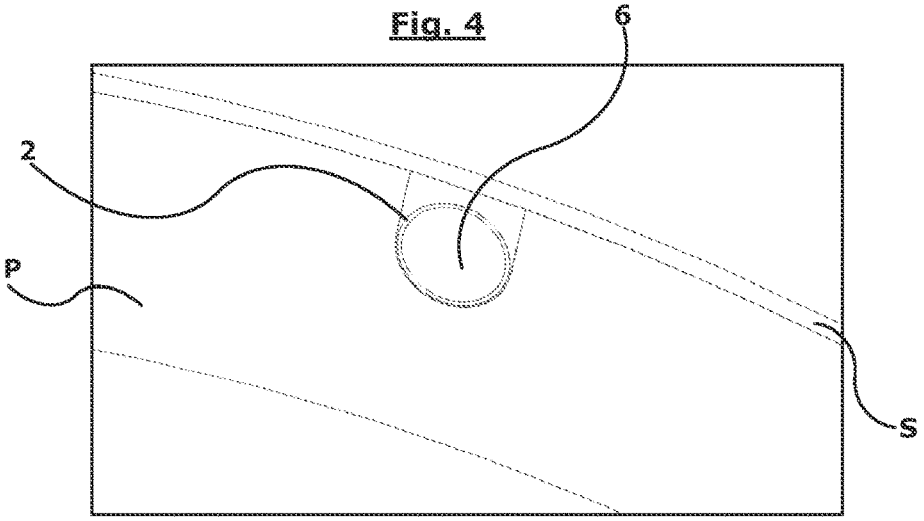
Figure 8A:
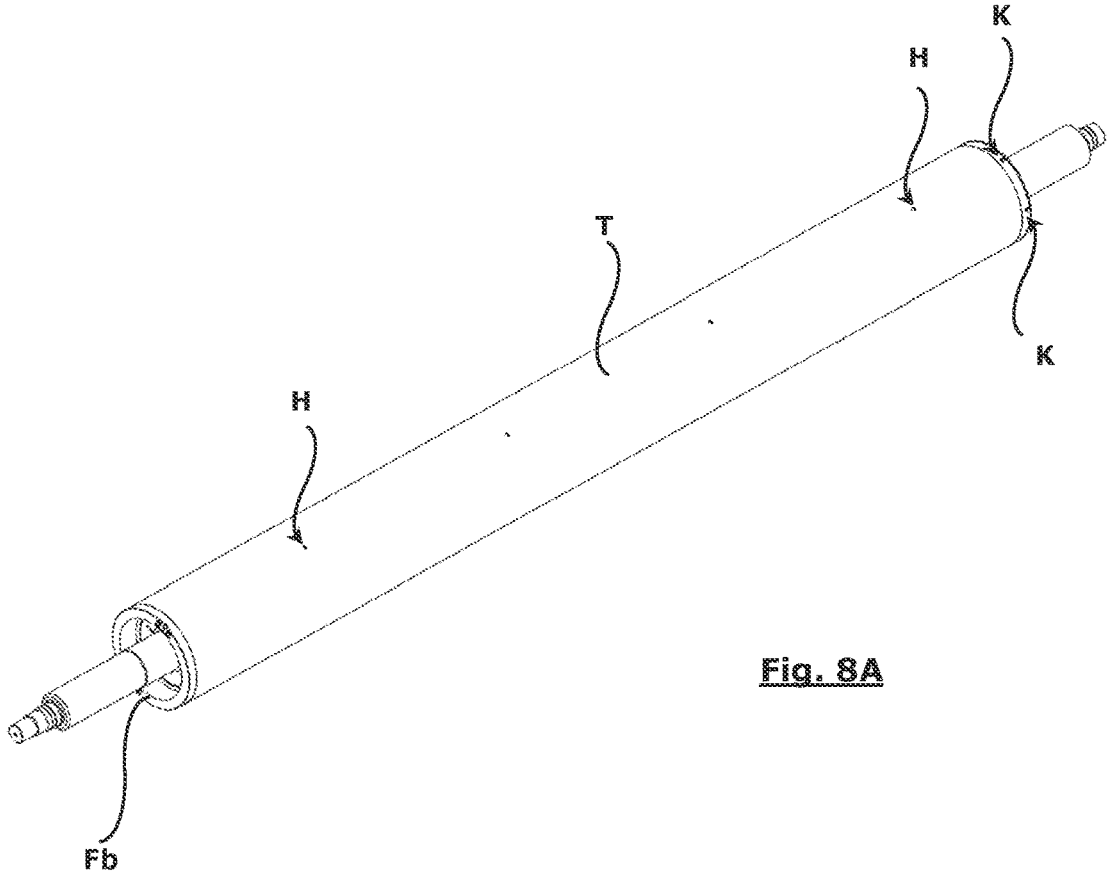
FIG. 8A is a perspective view of the plate sleeve-holder cylinder of the present invention in the whole, seen from the end flange into which compressed air is supplied.
Figure 8B:
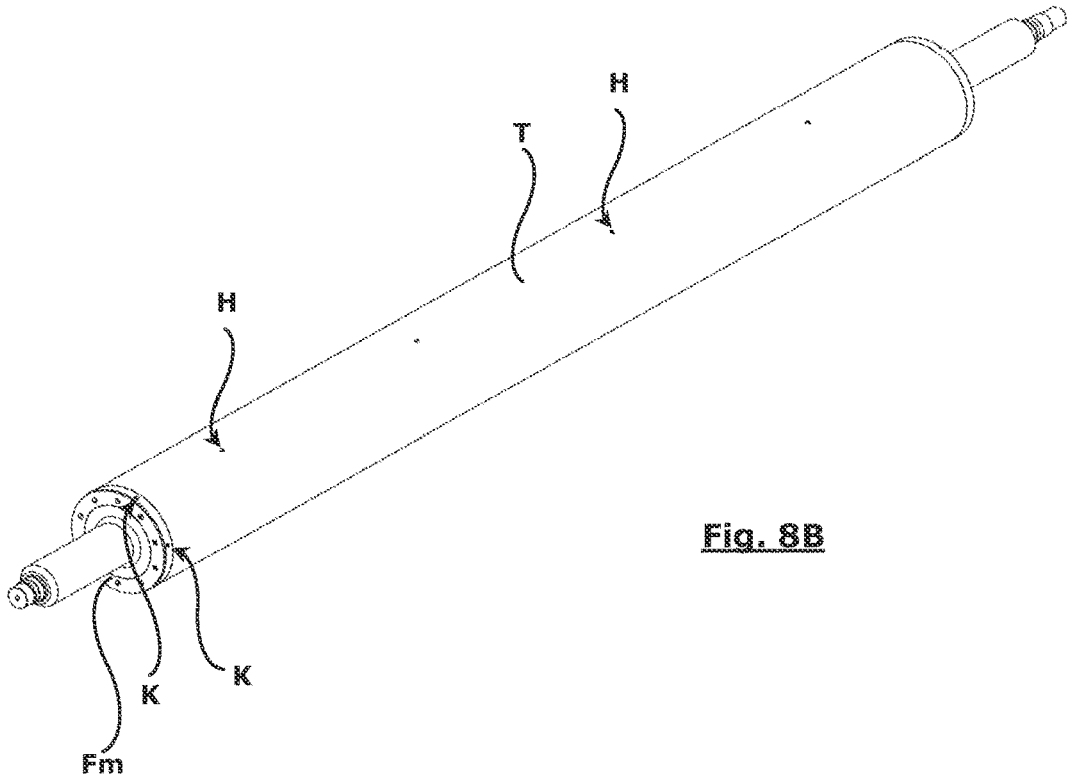
FIG. 8B is a perspective view of the plate sleeve-holder cylinder of FIG. 8A, seen from the opposite flange onto which sleeve insertion takes place.

In particular, a preferred manufacturing process of a central tube made of carbon-fibre composite material according to the present invention wherein air pipes for compressed air delivery are embedded, comprises the steps of:

a) a main lamination, preferably carried out with "filament winding" technology by means of resin-impregnated carbon fibres, for manufacturing the supporting structure (P) of the central tube made of composite material;

b) a polymerization of the resin of the supporting structure P obtained in step a);

c) a mechanical milling (FIG. 2) of the outer surface of the hardened supporting structure P of the central tube obtained in step b), for forming straight longitudinal grooves 1 in such outer surface of the supporting structure P, wide enough to house air pipes 6 of a desired size;

d) a formation of air pipes 6 for compressed air delivery (FIGS. 3 and 4) by inserting into the grooves 1 a thin cylindrical layer 2 of carbon fibres pre-impregnated with resin, radially wrapped around a metal mandrel 3 intended to be successively removed or around a hollow insert 4 made of plastic or metal intended to remain embedded within said cylindrical layer 2 of carbon fibres;

e) a filling of the residual space of grooves 1 with a polymerizable filling material 5, preferably with mono-directional carbon fibres pre-impregnated with resin;

f) a secondary lamination (FIGS. 4 and 5), preferably carried out with "wrapping" technology, by means of a resin-impregnated carbon-fibre fabric, for manufacturing a surface finishing structure S of the tube T made of composite material;

g) a polymerization of the resin contained in the cylindric layer 2, in the filling material 5 and in the surface finishing structure S;

h) a removal of mandrel 3 (FIG. 3), where present;

i) a mechanical drilling of the outer surface of the tube T made of composite material, in correspondence of air pipes 6, for forming vent holes H (FIG. 8) along said air pipes 6 at regular intervals.

As mentioned above, in step d) of formation of the air pipes 6 it is possible to use both removable metal mandrels 3 and disposable hollow inserts 4, intended to remain embedded in the structure of the central tube T made of carbon-fibres composite material during the lamination step. The choice between these two solutions can be dictated by geometric constraints, needs of the technological process or requirements of the air flow requested in the air pipes 6, based on the specific model of plate sleeve-holder cylinder.

Thanks to the manufacturing process described above it is generally possible to manufacture circular air pipes 6, housed into grooves 1 having a semi-circular bottom, as well as rectangular/squared air pipes 6 housed in grooves 1 having a flat bottom. In the drawings (FIGS. 6 and 7), two pipes 6 are illustrated arranged at 180° from each other on the surface of the central tube T made of composite material; such an arrangement, however, is not limitative and the number and arrangement of pipes 6 can be varied as will, based on the type, size and use of each single model of plate sleeve-holder cylinder.

Figure 6A:
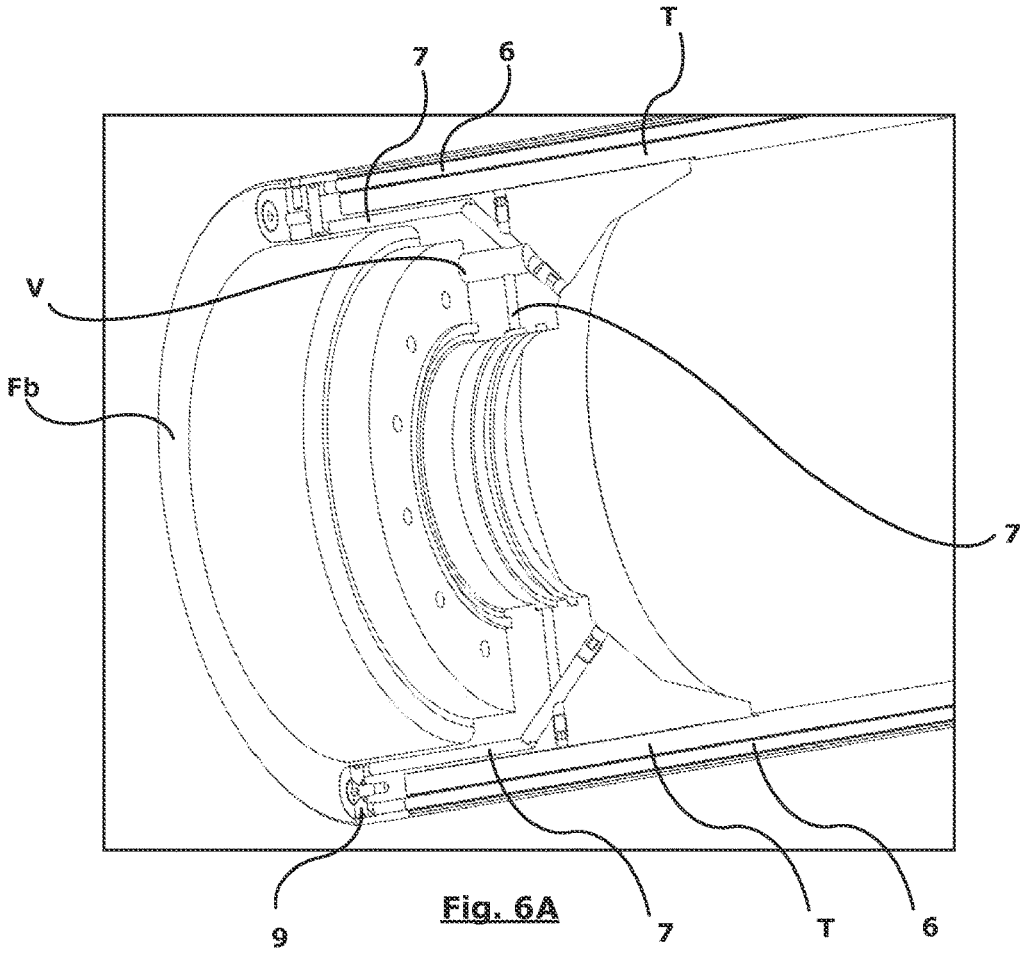
FIG. 6A is a partly broken away perspective view which illustrates channels formed in one of the end flanges of the plate sleeve-holder cylinder of the present invention for delivering compressed air.
Figure 6B:
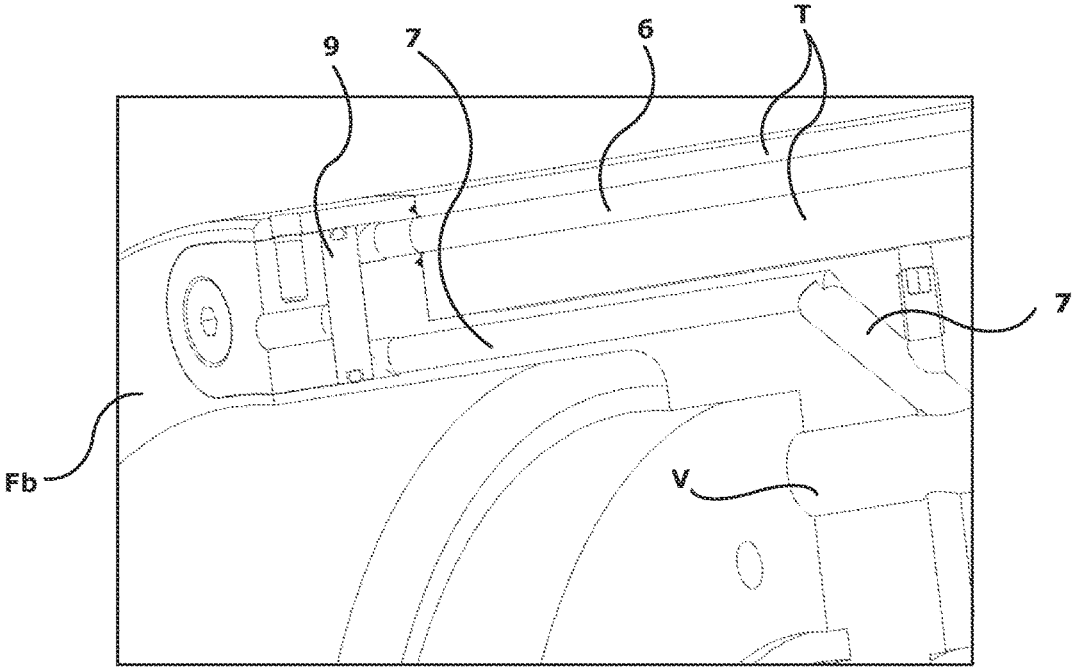
FIG. 6B is an enlarged view of a detail of FIG. 6A.
Figure 7A:
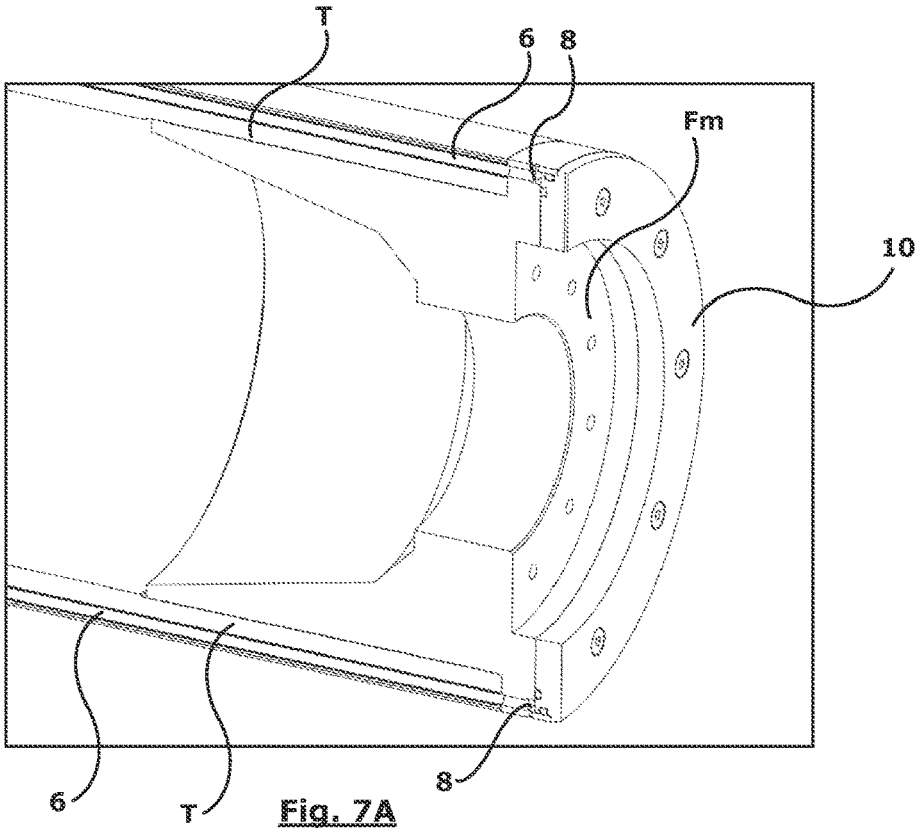
FIG. 7A is a partly broken away perspective view which illustrates the channels formed in the other end flange of the plate sleeve-holder cylinder of the present invention for delivering compressed air.
Figure 7B:
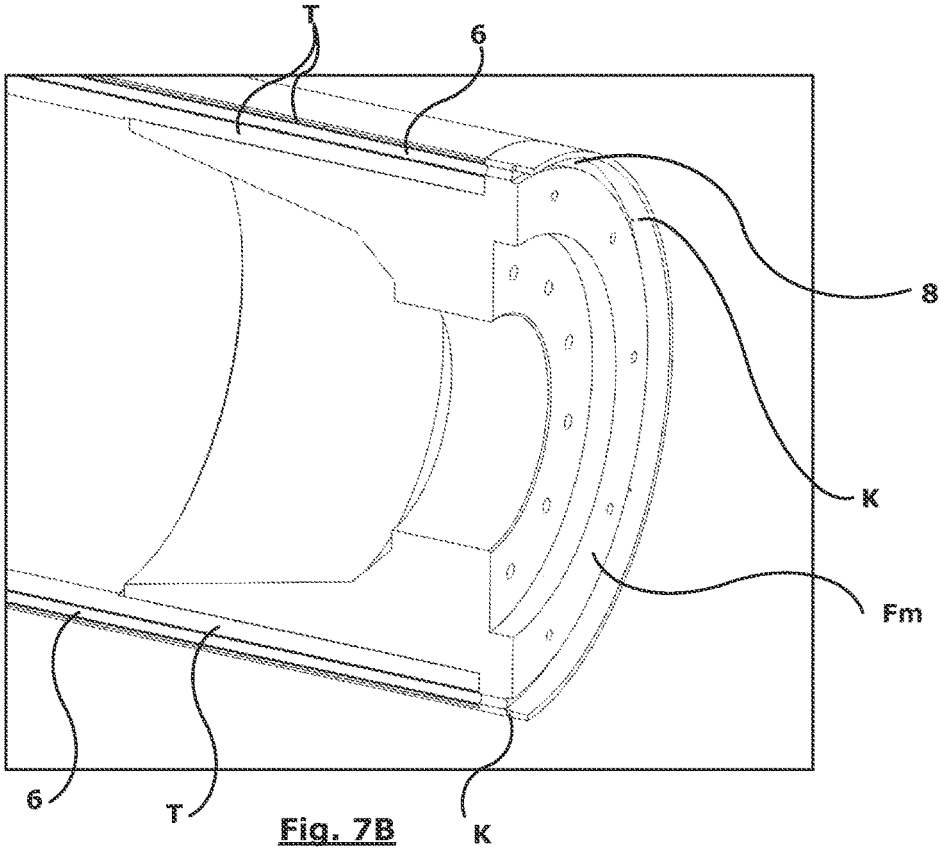
FIG. 7B is a view like FIG. 7A, without the outer sealing cover.

As shown in FIGS. 6A and 6B, air pipes 6 thus formed within tube T made of composite material are finally connected to each other and to an external valve V for compressed air supply by means of air channels 7 machined inside a flange Fb forming the base end of the plate sleeve-holder cylinder. As shown in FIGS. 7*a* and 7B a flange Fm which closes the opposite end of the plate sleeve-holder cylinder, i.e. the end onto which sleeve insertion takes place, is provided instead with a circular air channel 8 which connects the air pipes 6 between them and with a crown of radial vent holes K which allow that an uniform flow of compressed air springs from the outer edge of the flange Fm and therefore the required functionality of easing the initial insertion of the sleeves on the plate sleeve-holder cylinder is obtained.

Internal air seal of the working air pressure is ensured at the junctions between the air pipes 6 and the air channels 7 and 8, formed in the end flanges Fb and Fm, by the adhesive itself used to make these flanges integral with the central tube T made of composite material. Air seals towards the outside of air channels 7 and 8 are instead obtained, in a per se known manner, by means of circular diaphragms 9 in the flange Fb (FIG. 6B) and of a ring cover 10 in the flange Fm (FIG. 7A), respectively, both conveniently equipped with O-rings, as shown in the drawings.

Methods (coupling and adhesive bonding) for assembling the central tube T made of composite material and the metallic end flanges F must be therefore such as to ensure a perfect alignment between the air pipes 6 and the air channels 7 and 8 formed in the flanges Fb and Fm, and to ensure the relative air seal on frontal and cylindrical contact surfaces between these elements. To this purpose, centring dowels are preferably used, engaged with corresponding centring holes provided on the flanges F, from one side, and then with the air pipes 6 formed in the central tube T made of composite material, from the other side. Said dowels are placed in position when bonding the flanges Fb and Fm to the central tube T and are then subsequently extracted from outside the flanges when the bonding adhesive is sufficiently polymerized. Residual holes remained on the flanges are then closed with corresponding plugs.

The above-described technical solution can be equally applied both to plate sleeve-holder cylinders provided with conventional flanges F, i.e., made as a single piece of steel comprising both the actual flange and the respective rotation pin, and to plate sleeve-holder cylinders provided with two-pieces flanges F, i.e., an aluminium flange portion and a steel rotation pin screwed on the aluminium flange portion. Moreover, this latter solution remains perfectly safe, given the lack of compressed air inside the central tube T made of composite material, and it furthermore makes partially accessible the inside of the tube T made of composite material by removing the rotation pin from the aluminium flange portion bonded to the central tube T.

From the foregoing description it is evident that the plate sleeve-holder cylinder of the present invention has fully achieved the intended objects, as the compressed air pipes 6 are embedded within the same constituent elements of the plate sleeve-holder cylinder, without using additional or foreign elements. Said air pipe structure is therefore especially sturdy and reliable.

The plate sleeve-holder cylinder of the present invention also allows to achieve several operational advantages, which can be summarized as follows:

- complete safety for the operators, even in the event of loss of seal and accidental air leaks in, or breakages of, the central tube T made of composite material in correspondence of the air pipes 6, because the volume of air contained in such air pipes 6 is so low that it cannot give rise to sudden expulsions or sudden fractures of the components;
- the plate sleeve-holder cylinder should no longer be considered as a pressure vessel and therefore do not require to be subjected to the legal regulations of pressure vessels and the related certifications;
- any air leaks are easily detectable and, particularly in the case of a flexographic print cylinder with screwed pins, a fast repair can be allowed which does not affect the functionality of cylinder itself, and avoids being forced to discard the same;
- the low volume of air of the air pipes 6 and air channels 7 and 8 makes it possible to pressurize the circuit quickly, speeding up the operation of sleeve insertion;
- the manufacturing of the plate sleeve-holder cylinder is simple, and the structure obtained is more reliable in use, as no additional components difficult to assemble, or other solutions highly difficult to implement, are required, such as the use of a coaxial inner cylinder;

the manufacturing cost is comparable to the conventional solution with a central tube T having an inner pressurized chamber;

a highly flexible design about the choice of the number, shape, size and arrangement of air pipes 6 and holes H and K for the compressed air outlet is finally allowed.

It is understood, however, that the invention is not to be considered as limited to the arrangements illustrated above, which only are exemplary embodiments thereof, but that various variants are possible, all within the reach of a man of ordinary skill in the art, without departing from the scope of the invention itself, which is only defined by the following claims.

What is claimed is:

1. A plate sleeve-holder cylinder for flexographic printing comprising:

a carbon-fibre central tube (T) and first and second flanges (Fb, Fm) respectively provided on each end of said carbon-fibre central tube (T);

compressed air channels (6, 7, 8) arranged between one of the first and second flanges (Fb, Fm); and a plurality of vent holes (H) formed in the outer surface of said central tube (T) made of carbon-fibre composite material, in order to ease an insertion of sleeves onto said plate sleeve-holder cylinder;

wherein said air channels (6, 7, 8) are partly embedded within said first and second flanges (Fb, Fm), and partly embedded within a thickness of a side wall of said central tube (T) made of carbon-fibre composite material.

2. The plate sleeve-holder cylinder of claim 1, wherein the portion of said air channels (6, 7, 8) embedded within the thickness of the side wall of said central tube (T) of carbon-fibre composite material comprises one or more air pipes (6) housed in grooves (1) formed in a supporting structure (P) of the side wall of said central tube (T).

3. The plate sleeve-holder cylinder of claim 2, wherein a filling material (5) takes up a residual space of said grooves (1) housing an air pipe (6).

4. The plate sleeve-holder cylinder of claim 3, wherein said filling material (5) comprises monodirectional resin-impregnated carbon fibres.

5. The plate sleeve-holder cylinder of claim 2, wherein said one or more air pipes (6) comprises a thin layer (2) of carbon fibre, previously wrapped on a metal mandrel (3) and removed therefrom or wrapped on an embedded tubular insert (4) made of plastic or metal material.

6. The plate sleeve-holder cylinder of claim 2, wherein said plate sleeve-holder cylinder further comprises a coating layer (S) of resin-impregnated carbon-fibre fabric which covers the entire outer surface of said plate sleeve-holder cylinder and said grooves (1) housing the air pipes (6).

7. The plate sleeve-holder cylinder of claim 2, wherein said grooves (1) are straight and parallel to the axis of said central tube (T) made of carbon-fibre composite material.

8. The plate sleeve-holder cylinder of claim 2, wherein said one or more air pipes (6) are connected to each other and to an external valve (V) supplying compressed air, by means of air channels (7) formed within said first flange (Fb) which forms the base end of said plate sleeve-holder cylinder.

9. The plate sleeve-holder cylinder of claim 8, wherein an air channel (8) having a circular shape, which puts the air pipes (6) in communication with each other, is formed in said second flange (Fm) which closes the opposite end of the plate sleeve-holder cylinder, where the sleeves are inserted, said air channel (8) being provided with a plurality of radial vent holes (K) opening onto the external lateral surface of the second flange (Fm).

* * * * *